US011250792B2

(12) United States Patent
Wang et al.

(10) Patent No.: US 11,250,792 B2
(45) Date of Patent: Feb. 15, 2022

(54) BACKLIGHT PARTITION DRIVING MODULE, BACKLIGHT DEVICE, AND DISPLAY DEVICE

(71) Applicant: TCL CHINA STAR OPTOELECTRONICS TECHNOLOGY CO., LTD., Guangdong (CN)

(72) Inventors: Fuyi Wang, Guangdong (CN); Mingjong Jou, Guangdong (CN); Zhao Wang, Guangdong (CN); Fengcheng Xu, Guangdong (CN); Jinfeng Liu, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/969,625

(22) PCT Filed: May 12, 2020

(86) PCT No.: PCT/CN2020/089749
§ 371 (c)(1),
(2) Date: Aug. 13, 2020

(87) PCT Pub. No.: WO2021/212565
PCT Pub. Date: Oct. 28, 2021

(65) Prior Publication Data

US 2021/0335284 A1 Oct. 28, 2021

(30) Foreign Application Priority Data

Apr. 22, 2020 (CN) ..... 202010321644.6

(51) Int. Cl.
*G09G 3/34* (2006.01)

(52) U.S. Cl.
CPC ..... *G09G 3/342* (2013.01); *G09G 2310/027* (2013.01); *G09G 2310/0267* (2013.01); *G09G 2320/0626* (2013.01)

(58) Field of Classification Search
CPC .... G09G 3/36; G09G 2310/08; G09G 3/3208; G09G 2320/0626; G09G 3/20;
(Continued)

(56) References Cited

U.S. PATENT DOCUMENTS 5,901,181 A * 5/1999 LaGarde ..... H03K 5/086 375/317
8,554,279 B2 * 10/2013 Otaka ..... G09G 3/3406 455/566

(Continued)

*Primary Examiner* — Olga V Merkoulova
(74) *Attorney, Agent, or Firm* — Mark M. Friedman

(57) ABSTRACT

The present invention provides a backlight partition driving module, a backlight device, and a display device which include a signal input module configured to receive a driving signal, wherein the driving signal includes a brightness data signal, a scanning signal, and a function signal; a signal transmission module transmitting the driving signal; and a selection output module receiving the driving signal and is configured to output the scanning signal to a scanning line or the brightness data signal to a data line under control of the function signal.

15 Claims, 2 Drawing Sheets

(58) Field of Classification Search
CPC ..... G09G 2330/021; G09G 3/3426; G09G 2360/16; G09G 2354/00; G09G 2380/10; G09G 3/3406; G09G 3/34
See application file for complete search history.

(56) References Cited

U.S. PATENT DOCUMENTS

| | | | | |
|---|---|---|---|---|
| 10,984,732 | B2 * | 4/2021 | Zheng | H03F 3/45475 |
| 2002/0093477 | A1 * | 7/2002 | Wood | G09G 3/346 345/89 |
| 2005/0162375 | A1 * | 7/2005 | Koay | G06F 3/0317 345/102 |
| 2006/0007107 | A1 * | 1/2006 | Ferguson | G09G 3/3406 345/102 |
| 2007/0171182 | A1 * | 7/2007 | Mizuno | G09G 3/3406 345/102 |
| 2009/0256495 | A1 * | 10/2009 | Chao | H05B 45/48 315/294 |
| 2011/0032283 | A1 * | 2/2011 | Baek | G09G 3/3426 345/690 |
| 2011/0285325 | A1 * | 11/2011 | Jheng | H05B 45/10 315/312 |
| 2012/0206659 | A1 * | 8/2012 | Tsubata | G02F 1/134336 348/731 |
| 2014/0022289 | A1 * | 1/2014 | Lee | G09G 3/006 345/691 |
| 2014/0292634 | A1 * | 10/2014 | Kita | G09G 3/342 345/102 |
| 2015/0287375 | A1 * | 10/2015 | Tanaka | G09G 3/3614 345/209 |
| 2015/0379947 | A1 * | 12/2015 | Sang | G02F 1/134309 349/37 |
| 2021/0020137 | A1 * | 1/2021 | Jang | G09G 3/3688 |

* cited by examiner

BACKLIGHT PARTITION DRIVING MODULE, BACKLIGHT DEVICE, AND DISPLAY DEVICE

FIELD OF INVENTION

The present disclosure relates to the field of display technology, and more particularly, to a backlight partition driving module, a backlight device, and a display device.

BACKGROUND OF INVENTION

With vigorous development of an information society, driving technology of the display panel manufacturing industry has matured, and opportunities and challenges will follow. Due to limitations of liquid crystal display (LCD) backlight, such as high-power consumption and low contrast, the backlight is forced to develop in a direction of local dimming.

Current mini light-emitting diode (mini-LED) backlights adopt a static driving scheme or a passive matrix (PM) driving scheme to realize the local dimming of the backlight. Moreover, due to a greater number of backlight partitions, each backlight partition requires a data line for signal transmission, resulting in an excessive number of lines and driving modules, and a certain space for layout, which increases product costs.

SUMMARY OF INVENTION

An embodiment of the present disclosure provides a driving module, a backlight device, and a display device to solve a technical problem that current local dimming technology requires a greater number of driving modules due to a greater number of backlight partitions, resulting in increased product costs and limited number of backlight partitions.

In order to solve the above technical problem, the embodiment of the present disclosure provides a backlight partition driving module. The backlight partition driving module comprises a signal input module configured to receive a driving signal, wherein the driving signal comprises a brightness data signal, a scanning signal, and a function signal, a signal transmission module connected to the signal input module and receiving the driving signal, and a selection output module connected to the signal transmission module and receiving the driving signal, and is configured to output the scanning signal to a scanning line or the brightness data signal to a data line under control of the function signal.

In one embodiment of the present disclosure, the scanning signal comprises a first high potential signal and a first low potential signal, the brightness data signal comprises a first data signal and a second data signal, the first data signal and the second data signal are independently selected from one value in a gray-scale voltage database, the selection output module comprises a first switch and a second switch, wherein the first switch selects and turns on the first high potential signal or the first data signal, and the second switch selects and turns on the first low potential signal or the second data signal.

In one embodiment of the present disclosure, the selection output module comprises a signal output end, and a third and a fourth switch electrically connected to the signal output ends respectively, wherein the third switch is electrically connected to the first switch, and the fourth switch is electrically connected to the second switch.

In one embodiment of the present disclosure, the function signal comprises a first signal provided to the first switch and the second switch. When the first signal is 1, the first switch selects and turns on the first high potential signal to the third switch, and the second switch selects and turns on the first low potential signal to the fourth switch, or when the first signal is 0, the first switch selects and turns on the first data signal to the third switch, and the second switch selects and turns on the second data signal to the fourth switch.

In one embodiment of the present disclosure, the function signal comprises a second signal provided to the third switch and the fourth switch. When the second signal is 1, the third switch selects and turns on the first high potential signal or the first data signal to the signal output end, or when the second signal is 0, the fourth switch selects and turns on the first low potential signal or the second data signal to the signal output end.

In one embodiment of the present disclosure, the signal transmission module comprises a shift register and a line buffer configured to receive signals from the shift register, and the shift register receives the driving signal input by the signal input module and transmits the driving signal to the line buffer.

In one embodiment of the present disclosure, the line buffer comprises a first line buffer and a second line buffer, and at the same time, the first line buffer transmits a set of the drive signals to the selection output module, and the second line buffer stores another set of the drive signals.

A backlight device is provided according to the above purpose of the present disclosure. The backlight device comprises a plurality of sub-backlights, and each of the plurality of sub-backlights comprises a plurality of backlight partitions, wherein each of the plurality of sub-backlights are electrically connected to a backlight partition driving module, and the backlight partition driving module comprises a signal input module configured to receive a driving signal, wherein the driving signal comprises a brightness data signal, a scanning signal, and a function signal, a signal transmission module connected to the signal input module and receiving the driving signal, and a selection output module connected to the signal transmission module and receiving the driving signal, and is configured to output the scanning signal to a scanning line or the brightness data signal to a data line under control of the function signal.

In one embodiment of the present disclosure, the scanning signal comprises a first high potential signal and a first low potential signal, the brightness data signal comprises a first data signal and a second data signal, the first data signal and the second data signal are independently selected from one value in a gray-scale voltage database, the selection output module comprises a first switch and a second switch, wherein the first switch selects and turns on the first high potential signal or the first data signal, and the second switch selects and turns on the first low potential signal or the second data signal.

In one embodiment of the present disclosure, the selection output module comprises a signal output end, and a third and a fourth switch electrically connected to the signal output ends respectively, wherein the third switch is electrically connected to the first switch, and the fourth switch is electrically connected to the second switch.

In one embodiment of the present disclosure, the function signal comprises a first signal provided to the first switch and the second switch. When the first signal is 1, the first switch selects and turns on the first high potential signal to the third switch, and the second switch selects and turns on the first low potential signal to the fourth switch, or when the first signal is 0, the first switch selects and turns on the first data signal to the third switch, and the second switch selects and turns on the second data signal to the fourth switch.

In one embodiment of the present disclosure, the function signal comprises a second signal provided to the third switch and the fourth switch. When the second signal is 1, the third switch selects and turns on the first high potential signal or the first data signal to the signal output end, or when the second signal is 0, the fourth switch selects and turns on the first low potential signal or the second data signal to the signal output end.

In one embodiment of the present disclosure, the signal transmission module comprises a shift register and a line buffer configured to receive signals from the shift register, and the shift register receives the driving signal input by the signal input module and transmits the driving signal to the line buffer.

In one embodiment of the present disclosure, the line buffer comprises a first line buffer and a second line buffer, and at the same time, the first line buffer transmits a set of the drive signals to the selection output module, and the second line buffer stores another set of the drive signals.

In one embodiment of the present disclosure, each of the plurality of sub-backlights comprises a plurality of scanning lines and a plurality of data lines connected to and driving the plurality of backlight partitions by an active matrix method, and the selection output module outputs the scanning signal to the corresponding plurality of scanning lines or the brightness data signal to the corresponding plurality of data lines.

A display device is provided according to the above purpose of the present disclosure. The display device comprises a display panel and a backlight device, the backlight device is disposed on a side of the display panel and comprises a plurality of sub-backlights, and each of the plurality of sub-backlights comprises a plurality of backlight partitions, wherein each of the plurality of sub-backlights are electrically connected to a backlight partition driving module, and the backlight partition driving module comprises a signal input module configured to receive a driving signal, wherein the driving signal comprises a brightness data signal, a scanning signal, and a function signal, a signal transmission module connected to the signal input module and receiving the driving signal, and a selection output module connected to the signal transmission module and receiving the driving signal, and is configured to output the scanning signal to a scanning line or the brightness data signal to a data line under control of the function signal.

In one embodiment of the present disclosure, each of the plurality of sub-backlights comprises a plurality of scanning lines and a plurality of data lines connected to and driving the plurality of backlight partitions by an active matrix method, and the selection output module outputs the scanning signal to the corresponding plurality of scanning lines or the brightness data signal to the corresponding plurality of data lines.

In the present disclosure, the selection output module is disposed in the backlight partition driving module, and selects and turns on each group of drive signals to the corresponding scanning line or data line, which realize that the scanning line and the data line share a driving module. The plurality of backlight partitions are connected and driven through active matrix to realize that the plurality of backlight partitions can share one backlight partition driving module, which improves flexibility and universality of the backlight partition driving module, and greatly reduces a number of backlight partition driving modules, thereby increasing a number of backlight partitions and reducing product costs.

DESCRIPTION OF DRAWINGS

The detailed description of specific embodiments of the present disclosure will make technical solutions and other beneficial effects of the present disclosure obvious in the following with reference to the drawings.

DETAILED DESCRIPTION OF PREFERRED EMBODIMENTS

Figure 1:
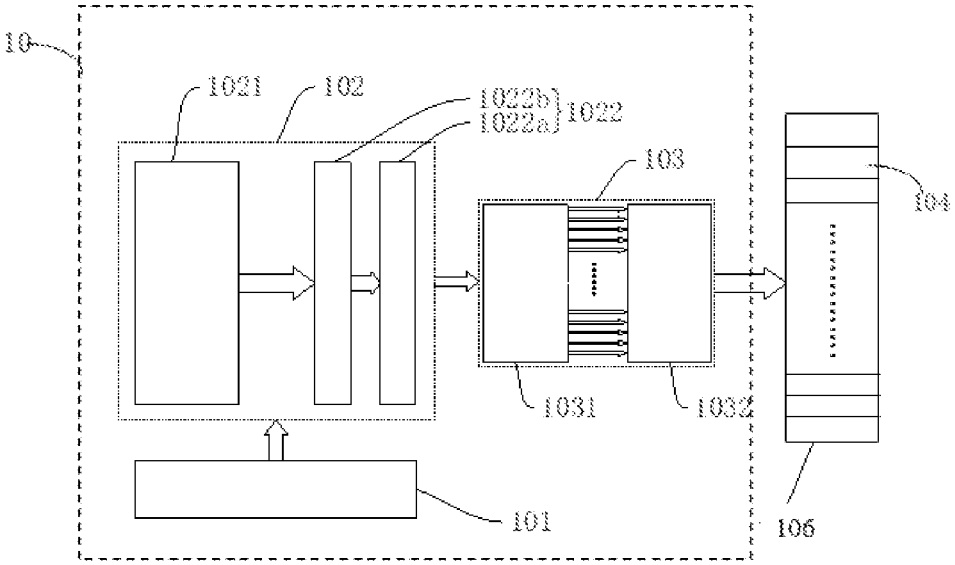
FIG. 1 is a schematic structural diagram of a backlight partition driving module provided by an embodiment of the present disclosure.

The technical solutions in the embodiments of the present disclosure will be clearly and completely described below in conjunction with accompanying drawings in the embodiments of the present disclosure. Obviously, the embodiments described are merely a part of the present disclosure, rather than all the embodiments. All other embodiments obtained by the person having ordinary skill in the art based on embodiments of the disclosure, without making creative efforts, are within the scope of the present disclosure.

In descriptions of the present disclosure, it should be noted that, orientations or position relationships indicated by the terms, such as "center", "longitudinal", "transverse", "length", "width", "thickness", "upper", "lower", "front", "back", "left", "right", "vertical", "horizontal", "top", "bottom", "inside", "outside", "clockwise", "counterclockwise", etc. are based on the orientations or position relationships shown in the drawings. These are only convenience for describing the present disclosure and simplifying the descriptions, and does not indicate or imply that the device or element must have a specific orientation, a structure and an operation in the specific orientation, so it cannot be understood as a limitation on the present disclosure. In addition, the terms "first" and "second" are used for describing purposes only, and cannot be understood as indicating or implying relative importance or implicitly indicating the number of technical features indicated. Thus, the features defined as "first" and "second" may explicitly or implicitly include one or more of the features. In the descriptions of the present disclosure, the meaning of "plurality" is two or more, unless it is specifically defined otherwise.

In the present disclosure, the terms "mounting", "connected", "fixed" and the like should be broadly understood unless expressly stated or limited otherwise. For example, it may be fixed connected, removably connected, or integrated; it may be mechanically connected, or an electrically connected; it may be directly connected, or indirectly connected through an intermediary; it may be a connection between two elements or an interaction between two elements. For those skilled in the art, the specific meanings of the above terms in the present disclosure may be understood based on specific situations.

In the present disclosure, unless explicitly stated and defined otherwise, the first feature may be "above" or "below" the second feature and may include direct contact between the first and second features. It may also include that the first and second features are not in direct contact but are contacted by another feature between them. Moreover, the first feature is "above" the second feature, including the first feature directly above and obliquely above the second feature, or merely indicates that the first feature is higher in level than the second feature. The first feature is "below" the second feature, including the first feature is directly below and obliquely below the second feature, or only indicates that the first feature is less horizontal than the second feature.

The following disclosure provides many different embodiments or examples for achieving different structures of the present disclosure. To simplify the present disclosure, components and settings of specific examples are described below. They are only examples and are not intended to limit the present disclosure. In addition, the present disclosure may repeat reference numbers and/or reference letters in different examples, this repetition is for the purpose of simplicity and clarity, and does not itself indicate the relationship between various embodiments and/or settings discussed. In addition, the present disclosure provides examples of various specific processes and materials, but those of ordinary skill in the art may be aware of the present disclosure of other processes and/or the use of other materials.

The embodiment of the present disclosure is directed to a technical problem that current local dimming technology requires a greater number of driving modules due to a greater number of backlight partitions, resulting in increased product costs and limited number of backlight partitions.

In order to solve the above technical problem, the embodiment of the present disclosure provides a backlight partition driving module. Refer to FIG. 1, the backlight partition driving module 10 comprises a signal input module 101 configured to receive a driving signal, wherein the driving signal comprises a brightness data signal, a scanning signal, and a function signal, a signal transmission module 102 connected to the signal input module 101 and receives the driving signal, and a selection output module 103 connected to the signal transmission module 102 and receives the driving signal, and to output the scanning signal to a scanning line, or the brightness data signal to a data line under control of the function signal.

In an implementation process, a data line needs to be disposed in each backlight partition for voltage signal transmission in a current local dimming backlight device. Therefore, a greater number of lines and driving modules need to be disposed to realize a controllable operation of each backlight partition and requires space to install a greater number of driving modules, which increases product costs and is inconducive to thin and lightweight products. Moreover, the selection output module is disposed in the backlight partition driving module provided by the embodiment of the present disclosure, controlling the driving signal to be selectively output to the scanning line or data line, realizing that the scanning line and the data line share one driving module. The plurality of backlight partitions are connected and driven through an active matrix to realize that the plurality of backlight partitions can share one backlight partition driving module, which improves flexibility and universality of the backlight partition driving module, and greatly reduces a number of backlight partition driving modules, thereby increasing a number of backlight partitions and reducing product costs.

Specifically, refer to FIG. 1, the backlight partition driving module 10 comprises the signal input module 101, the signal transmission module 102, and the selection output module 103.

Wherein, the signal input module 101 is connected to the signal transmission module 102 to output the driving signal to the signal transmission module 102, the signal transmission module 102 transmits the driving signal to the selection output module 103, and the selection output module 103 selects and outputs the driving signal to the corresponding scanning line or data line in a backlight partition 104.

The driving signal comprises a brightness data signal, a scanning signal, and a function signal, wherein the selection module 103 outputs the scan signal to the scan line or the brightness data signal to the data line according to the function signal. Therefore, one backlight partition driving module can output signals to a plurality of scanning lines and a plurality of data lines, so that the plurality of backlight partitions share one backlight partition driving module, and the scanning lines and the data lines share one backlight partition driving module.

In the embodiment of the present disclosure, the signal transmission module 102 comprises a shift register 1021 and a line buffer 1022 configured to receive signals from the shift register 1021, and the shift register 1021 receives the driving signal input by the signal input module 101 and transmits the driving signal to the line buffer 1022, wherein the line buffer 1022 comprises a first line buffer 1022*a* and a second line buffer 1022*b* connected in series, and at the same time, the first line buffer 1022*a* section transmits a set of the drive signals to the selection output module 103, and the second line buffer 1022*b* stores another set of the drive signals, that is, the shift register 1021 transmits a plurality of sets of the drive signals to the line buffer 1022 in sequence, and when the second line buffer 1022*b* receives the driving signal, the first line buffer 1022*a* transmits the drive signal stored therein to the selection output module 103, and the selection output module 103 transmits the scanning signal to the scanning line or transmits the brightness data signal to the data line according to the function signal.

The selection output module 103 comprises a signal selection unit 1031 and a signal output unit 1032 electrically connected to the signal selection unit 1031, wherein the signal selection unit 1031 determines and selects the signal output unit 1032 to output the scanning signal to the scanning line or output the brightness data signal to the data line. It should be noted that the signal output unit 1032 further comprises a buffer configured to receive signals from the signal selection unit 1031 to improve signal transmission capability and driving capability.

Figure 2:
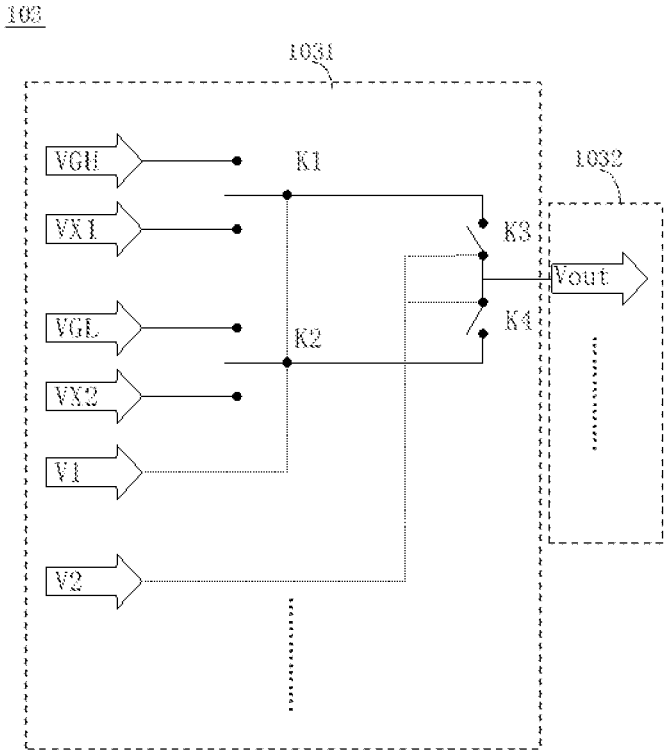
FIG. 2 is a schematic structural diagram of a circuit structure of a selection output module provided by the embodiment of the present disclosure.

Furthermore, referring to FIG. 2, FIG. 2 is a schematic diagram of a circuit structure of a selection output module provided by the embodiment of the present disclosure. It should be noted that the signal selection unit 1031 comprises a plurality of signal selection circuits, the signal output unit 1032 comprises a plurality of signal output ends Vout. Correspondingly, each signal selection circuit can be electrically connected to one signal output end Vout to determine and select the corresponding signal output end Vout to output the scanning signal or output the brightness data signal. Hence, in the embodiment of the present disclosure, a group of the signal selection circuit and the corresponding signal output end Vout are taken as an example to describe the selection output module provided in the embodiment of the present disclosure in detail.

In the embodiment of the present disclosure, the scanning signal comprises a first high potential signal VGH and a first low potential signal VGL, the brightness data signal comprises a first data signal VX1 and a second data signal VX2, wherein the first data signal VX1 and the second data signal VX2 are independently selected from one value in a gray-scale voltage database.

The selection output module comprises a first switch K1 and a second switch K2, wherein the first switch K1 selects and turns on the first high potential signal VGH or the first data signal VX1, and the second switch K2 selects and turns on the first low potential signal VGL or the second data signal VX2.

Correspondingly, the selection output module further comprises a third switch K3 and a fourth switch K4 that are electrically connected to the signal output ends Vout respectively, wherein the third switch K3 is electrically connected to the first switch K1, and the fourth switch K4 is electrically connected to the second switch K2.

The function signal comprises a first signal V1 provided to the first switch K1 and the second switch K2, and a second signal V2 provided to the third switch K3 and the fourth switch K4, wherein the function signal as a 2-bit signal is taken as an example, a principle of a selection output process of the selection output module 103 in the embodiment of the present disclosure is described.

When the first signal V1 is 1, the first switch K1 selects and turns on the first high potential signal VGH to the third switch K3, and the second switch K2 selects and turns on the first low potential signal VGL to the fourth switch K4, or when the first signal V1 is 0, the first switch K1 selects and turns on the first data signal VX1 to the third switch K3, and the second switch K2 selects and turns on the second data signal VX2 to the fourth switch K4.

When the second signal V2 is 1, the third switch K3 selects and turns on the first high potential signal VGH or the first data signal VX1 to the signal output end Vout, or when the second signal V2 is 0, the fourth switch K4 selects and turns on the first low potential signal VGL or the second data signal VX2 to the signal output end Vout.

For example, when the function signal is "11", the corresponding signal output end Vout outputs the first high potential signal VGH to the corresponding scanning line, and when the function signal is "01", the corresponding signal output end Vout outputs the first data signal VX1 to the corresponding data line.

After a determination of the selection output module 103, an output of the plurality of signal output ends Vout can be selected as the scanning line or the data line, so that a purpose of the plurality of scanning lines and the plurality of data lines can be integrated and shared by one driving module.

In summary, the selection output module is disposed in the backlight partition driving module provided by the embodiment of the present disclosure to control the driving signal to be selectively output to the scanning line or data line, which realize that the scanning line and the data line share one driving module. The plurality of backlight partitions are connected and driven through active matrix to realize that the plurality of backlight partitions can share one backlight partition driving module, which improves flexibility and universality of the backlight partition driving module, and greatly reduces the number of backlight partition driving modules, thereby increasing the number of backlight partitions and reducing product costs.

Figure 3:
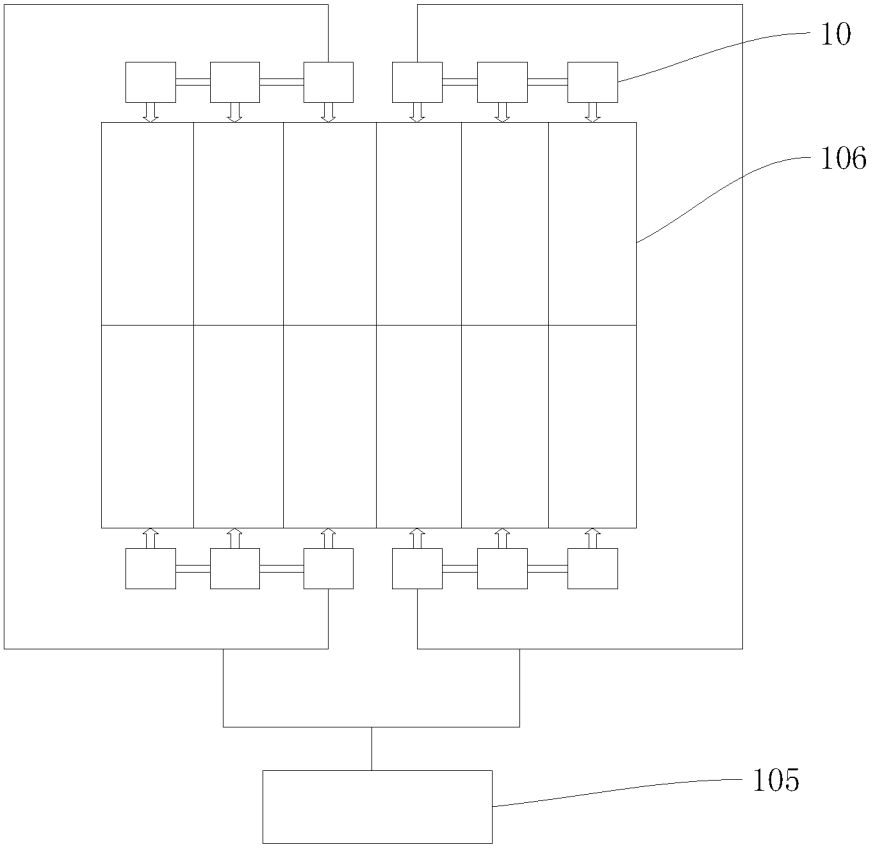
FIG. 3 is a schematic structural diagram of a backlight device provided by the embodiment of the present disclosure.

In addition, the embodiment of the present disclosure further provides a backlight device, referring to FIG. 3, the backlight device comprises a plurality of sub-backlights 106, and each of the plurality of sub-backlights 106 comprises a plurality of backlight partitions, wherein each of the plurality of sub-backlights 106 is electrically connected to a backlight partition driving module 10, and the backlight partition driving module is the backlight partition driving module in the above embodiment whose structure and principle are same as those described in the above embodiments, and will not be described here. Moreover, the backlight device further comprises a system control board 105 electrically connected to the plurality of backlight partition driving modules 10 to transmit data signals to each backlight partition driving module 10.

Wherein, each of the plurality of sub-backlights 106 comprises the plurality of scanning lines and the plurality of data lines connected to and driving the plurality of backlight partitions by an active matrix method, and the selection output module 103 outputs the scanning signal to the corresponding plurality of scanning lines or the brightness data signal to the corresponding plurality of data lines to control brightness of each backlight partition, so that the plurality of backlight partitions share one driving module, and the scanning lines and the data lines share one driving module.

The backlight partition driving module with the selection output module is disposed in the backlight device provided by the embodiment of the present disclosure, which can realize that the scanning line and the data line share one driving module, and the plurality of the backlight partitions share one driving module, so that the number of backlight partition driving modules is greatly reduced, thereby increasing the number of backlight partitions and reducing product costs.

The embodiment of the present disclosure further provides a display device, the display device comprises the backlight device in the above embodiment, and a display panel, wherein the backlight device is disposed on a side of the display panel.

In the above embodiments, description of each embodiment has its own emphasis. For a part that is not detailed in an embodiment, referring to the related descriptions of other embodiments.

The driving module, the backlight device with the driving module, and the display device with the backlight device provided by the embodiments of the present disclosure have been described in detail above. The present disclosure uses specific examples to describe principles and embodiments of the present disclosure. The descriptions of the above embodiments are only used to help understand technical solutions of the present disclosure and core ideas thereof. Moreover, those of ordinary skill in the art should understand that the technical solutions described in the aforesaid embodiments can still be modified, or have some technical features equivalently replaced. However, these modifications or replacements do not depart from a scope of the technical solutions of the embodiments of the present disclosure.

What is claimed is:

1. A backlight partition driving module, comprising:

a signal input module configured to output driving signals, wherein the driving signals comprise brightness data signals, scanning signals, and function signals;

a signal transmission module connected to the signal input module for receiving the driving signals; and a selection output module connected to the signal transmission module for receiving the driving signals, wherein the selection output module comprises a plurality of signal output ends and is configured to output either one of the scanning signals or the brightness data signals by one of the signal output ends under control of the function signals;

wherein the scanning signals comprise a first high potential signal and a first low potential signal, the brightness data signals comprise a first data signal and a second data signal, the first data signal and the second data signal are independently selected from one value in a gray-scale voltage database, the selection output module comprises a plurality of signal selection circuits, and each of the signal selection circuits comprises a first switch and a second switch, wherein the first switch is configured to select and turn on the first high potential signal or the first data signal, and the second switch is configured to select and turn on the first low potential signal or the second data signal.

2. The backlight partition driving module as claimed in claim 1, wherein each of the signal selection circuits further comprises a third switch and a fourth switch electrically connected to one of the signal output ends, respectively, the third switch is electrically connected to the first switch, and the fourth switch is electrically connected to the second switch.

3. The backlight partition driving module as claimed in claim 2, wherein the function signals comprise a first signal provided to the first switch and the second switch;

when the first signal is 1, the first switch selects and turns on the first high potential signal to the third switch, and the second switch selects and turns on the first low potential signal to the fourth switch; or when the first signal is 0, the first switch selects and turns on the first data signal to the third switch, and the second switch selects and turns on the second data signal to the fourth switch.

4. The backlight partition driving module as claimed in claim 3, wherein the function signals comprise a second signal provided to the third switch and the fourth switch;

when the second signal is 1, the third switch selects and turns on the first high potential signal or the first data signal to the signal output end; or when the second signal is 0, the fourth switch selects and turns on the first low potential signal or the second data signal to the signal output end.

5. The backlight partition driving module as claimed in claim 1, wherein the signal transmission module comprises a shift register and line buffers configured to receive signals from the shift register, and the shift register receives the driving signals input by the signal input module and transmits the driving signals to the line buffers.

6. The backlight partition driving module as claimed in claim 5, wherein the line buffers comprise a first line buffer and a second line buffer, and at a same time, the first line buffer transmits a set of the driving signals to the selection output module, and the second line buffer stores another set of the driving signals.

7. A backlight device, wherein the backlight device comprises a plurality of sub-backlights, and each of the plurality of sub-backlights comprises a plurality of backlight partitions, wherein each of the plurality of sub-backlights is electrically connected to a backlight partition driving module, and the backlight partition driving module comprises:

a signal input module configured to output driving signals, wherein the driving signals comprise brightness data signals, scanning signals, and function signals;

a signal transmission module connected to the signal input module for receiving the driving signals; and a selection output module connected to the signal transmission module for receiving the driving signals, wherein the selection output module comprises a plurality of signal output ends and is configured to output either one of the scanning signals or the brightness data signals by one of the signal output ends under control of the function signals;

wherein the scanning signals comprise a first high potential signal and a first low potential signal, the brightness data signals comprise a first data signal and a second data signal, the first data signal and the second data signal are independently selected from one value in a gray-scale voltage database, the selection output module comprises a plurality of signal selection circuits, and each of the signal selection circuits comprises a first switch and a second switch, wherein the first switch is configured to select and turn on the first high potential signal or the first data signal, and the second switch is configured to select and turn on the first low potential signal or the second data signal.

8. The backlight device as claimed in claim 7, wherein each of the signal selection circuits further comprises a third switch and a fourth switch electrically connected to one of the signal output ends, respectively, the third switch is electrically connected to the first switch, and the fourth switch is electrically connected to the second switch.

9. The backlight device as claimed in claim 8, wherein the function signals comprise a first signal provided to the first switch and the second switch;

when the first signal is 1, the first switch selects and turns on the first high potential signal to the third switch, and the second switch selects and turns on the first low potential signal to the fourth switch; or when the first signal is 0, the first switch selects and turns on the first data signal to the third switch, and the second switch selects and turns on the second data signal to the fourth switch.

10. The backlight device as claimed in claim 9, wherein the function signals comprise a second signal provided to the third switch and the fourth switch;

when the second signal is 1, the third switch selects and turns on the first high potential signal or the first data signal to the signal output end; or when the second signal is 0, the fourth switch selects and turns on the first low potential signal or the second data signal to the signal output end.

11. The backlight device as claimed in claim 7, wherein the signal transmission module comprises a shift register and line buffers configured to receive signals from the shift register, and the shift register receives the driving signals input by the signal input module and transmits the driving signals to the line buffers.

12. The backlight device as claimed in claim 11, wherein the line buffers comprise a first line buffer and a second line buffer, and at a same time, the first line buffer transmits a set of the driving signals to the selection output module, and the second line buffer stores another set of the driving signals.

13. The backlight device as claimed in claim 7, wherein each of the plurality of sub-backlights comprises a plurality of scanning lines and a plurality of data lines connected to and driving the plurality of backlight partitions by an active matrix method, and the selection output module outputs the scanning signals to corresponding scanning lines or outputs the brightness data signals to corresponding data lines.

14. A display device, wherein the display device comprises a display panel and a backlight device, the backlight device is disposed on one side of the display panel and comprises a plurality of sub-backlights, and each of the plurality of sub-backlights comprises a plurality of backlight partitions, wherein each of the plurality of sub-backlights is electrically connected to a backlight partition driving module, and the backlight partition driving module comprises:

a signal input module configured to output driving signals, wherein the driving signals comprise brightness data signals, scanning signals, and function signals;

a signal transmission module connected to the signal input module for receiving the driving signals; and a selection output module connected to the signal transmission module for receiving the driving signals, wherein the selection output module comprises a plurality of signal output ends and is configured to output either one of the scanning signals or the brightness data signals by one of the signal output ends under control of the function signals;

wherein the scanning signals comprise a first high potential signal and a first low potential signal, the brightness data signals comprise a first data signal and a second data signal, the first data signal and the second data signal are independently selected from one value in a gray-scale voltage database, the selection output module comprises a plurality of signal selection circuits, and each of the signal selection circuits comprises a first switch and a second switch, wherein the first switch is configured to select and turn on the first high potential signal or the first data signal, and the second switch is configured to select and turn on the first low potential signal or the second data signal.

15. The display device as claimed in claim 14, wherein each of the plurality of sub-backlights comprises a plurality of scanning lines and a plurality of data lines connected to and driving the plurality of backlight partitions by an active matrix method, and the selection output module outputs the scanning signals to corresponding scanning lines or outputs the brightness data signals to corresponding data lines.

* * * * *